US006230691B1

(12) United States Patent
Coha et al.

(10) Patent No.: US 6,230,691 B1
(45) Date of Patent: May 15, 2001

(54) SECONDARY FUEL PUMP ASSEMBLY FOR A FUEL TANK

(75) Inventors: Timothy Francis Coha, Luxembourg (LU); Sharon Elizabeth Beyer, Grand Blanc, MI (US); Mark K. Wolfenden, Burton, MI (US); Ulf Sawert, Grand Blanc, MI (US); Chris Clarence Begley, Ortonville, MI (US); Dale Richard Jones, Flushing, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/630,486

(22) Filed: Aug. 2, 2000

(51) Int. Cl.[7] ..... F02M 37/04

(52) U.S. Cl. ..... 123/514; 123/509; 137/574; 137/565.22; 251/343

(58) Field of Search ..... 123/514, 509, 123/516, 510; 137/565.22, 565.37, 574, 428, 433; 251/343

(56) References Cited

U.S. PATENT DOCUMENTS 4,747,388 * 5/1988 Tuckey ..... 123/514
4,856,756 * 8/1989 Combs ..... 251/297
4,878,518 * 11/1989 Tuckey ..... 137/448
4,971,017 * 11/1990 Beakley et al. ..... 123/510
5,050,567 * 9/1991 Suzuki ..... 123/514
5,070,849 * 12/1991 Rich et al. ..... 123/509
5,080,077 * 1/1992 Sawert et al. ..... 137/574
5,197,445 * 3/1993 Casari ..... 123/514
5,201,298 * 4/1993 Shearn ..... 123/514
5,447,175 * 9/1995 Takaki et al. ..... 137/399
5,564,397 * 10/1996 Kleppner et al. ..... 123/514
5,785,084 * 7/1998 Richter et al. ..... 137/549
5,809,975 * 9/1998 Tuckey et al. ..... 123/509

* cited by examiner

*Primary Examiner*—Carl S. Miller
(74) *Attorney, Agent, or Firm*—Vincent A. Cichosz

(57) ABSTRACT

A secondary fuel pump assembly for a fuel tank in a vehicle includes a reservoir adapted to be disposed in the fuel tank having a top defining an overflow fuel level of the reservoir. The secondary fuel pump assembly also includes a conduit conducting return fuel from an engine of the vehicle to the reservoir and a jet pump having a discharge outlet in the reservoir and an inlet operatively connected to the conduit. The secondary fuel pump assembly includes an overflow fuel member defining a flow path for overflow of fuel in the reservoir and a guide member extending into the overflow fuel member and having at least one aperture extending therethough. The secondary fuel pump assembly further includes a guide disposed over the guide member and movable relative thereto to open and close the at least one aperture and a float connected to the guide to move the guide as a fuel level rises and falls in the reservoir.

20 Claims, 4 Drawing Sheets

SECONDARY FUEL PUMP ASSEMBLY FOR A FUEL TANK

TECHNICAL FIELD

The present invention relates generally to fuel tanks for vehicles and, more particularly, to a secondary fuel pump assembly for a fuel tank of a vehicle.

BACKGROUND OF THE INVENTION

It is known to provide a fuel tank for a vehicle to hold fuel to be used by an engine of the vehicle. In some vehicles, the fuel tank includes a fuel pump module disposed therein with a removable cover sealed to the top of the fuel tank having an electrical connector and a fuel line outlet connector. The fuel pump module includes a fuel reservoir, an electrical fuel pump disposed in the reservoir with an inlet (not shown) at a bottom thereof and a secondary pump used to fill the reservoir to overfilling. This overfilling of the reservoir allows the generation of vapors due to the agitation of the fuel as well as the mixing of the hot fuel, being returned from an engine of the vehicle, with bulk fuel.

An example of a fuel pump module is disclosed in U.S. Pat. No. 5,218,942 to Coha et al. In this patent, the fuel pump module includes a fuel pump disposed in the reservoir, a low pressure conduit conducting hot return fuel back to the reservoir, a secondary pump disposed in the reservoir for pumping new fuel from the fuel tank into the reservoir, and a control which effects a recirculation mode of secondary pump operation when the new fuel level in the fuel tank is above a predetermined low level and a scavenge mode of secondary pump operation when the new fuel level in the reservoir is below the predetermined low level. The secondary pump includes a high-pressure jet pump having consistent flow and a float mechanism to switch the jet pump from drawing external fuel to the reservoir and vice versa.

Therefore, it is desirable to provide a new secondary fuel pump for a fuel tank in a vehicle. It is also desirable to provide a secondary fuel pump for a fuel tank in a vehicle that reduces vapor generation. It is further desirable to provide a secondary fuel pump for a fuel tank in a vehicle that has no moving or extra parts.

SUMMARY OF THE INVENTION

It is, therefore, one object of the present invention to provide a new secondary fuel pump assembly for a fuel tank in a vehicle.

It is another object of the present invention to provide a secondary fuel pump assembly for a fuel tank in a vehicle that reduces vapor generation.

To achieve the foregoing objects, the present invention is a secondary fuel pump assembly for a fuel tank in a vehicle including a reservoir adapted to be disposed in the fuel tank having a top defining an overflow fuel level of the reservoir. The secondary fuel pump assembly also includes a conduit conducting return fuel from an engine of the vehicle to the reservoir and a jet pump having a discharge outlet in the reservoir and an inlet operatively connected to the conduit. The secondary fuel pump assembly includes an overflow fuel member defining a flow path for overflow of fuel in the reservoir and a guide member extending into the overflow fuel member and having at least one aperture extending therethough. The secondary fuel pump assembly further includes a guide disposed over the guide member and movable relative thereto to open and close the at least one aperture and a float connected to the guide to move the guide as a fuel level rises and falls in the reservoir.

One advantage of the present invention is that a secondary fuel pump assembly is provided for a fuel tank in a vehicle.

Another advantage of the present invention is that the secondary fuel pump assembly reduces vapor generation by allowing the preferential use of "hot" fuel, returned from the engine or fuel which has been by-passed by the fuel regulator if the fuel regulator is in the fuel pump module or in close proximity to the fuel pump module, on a preferential basis. Yet another advantage of the present invention is that the secondary fuel pump assembly integrates an additional tube into the reservoir, thereby requiring no extra parts. Still another advantage of the present invention is that the secondary fuel pump assembly is lower in cost, simpler and improves quality over existing designs.

Other objects, features and advantages of the present invention will be readily appreciated, as the same becomes better understood, after reading the subsequent description taken in conjunction with the accompanying drawings.

DESCRIPTION OF THE PREFERRED EMBODIMENT

Figure 1:
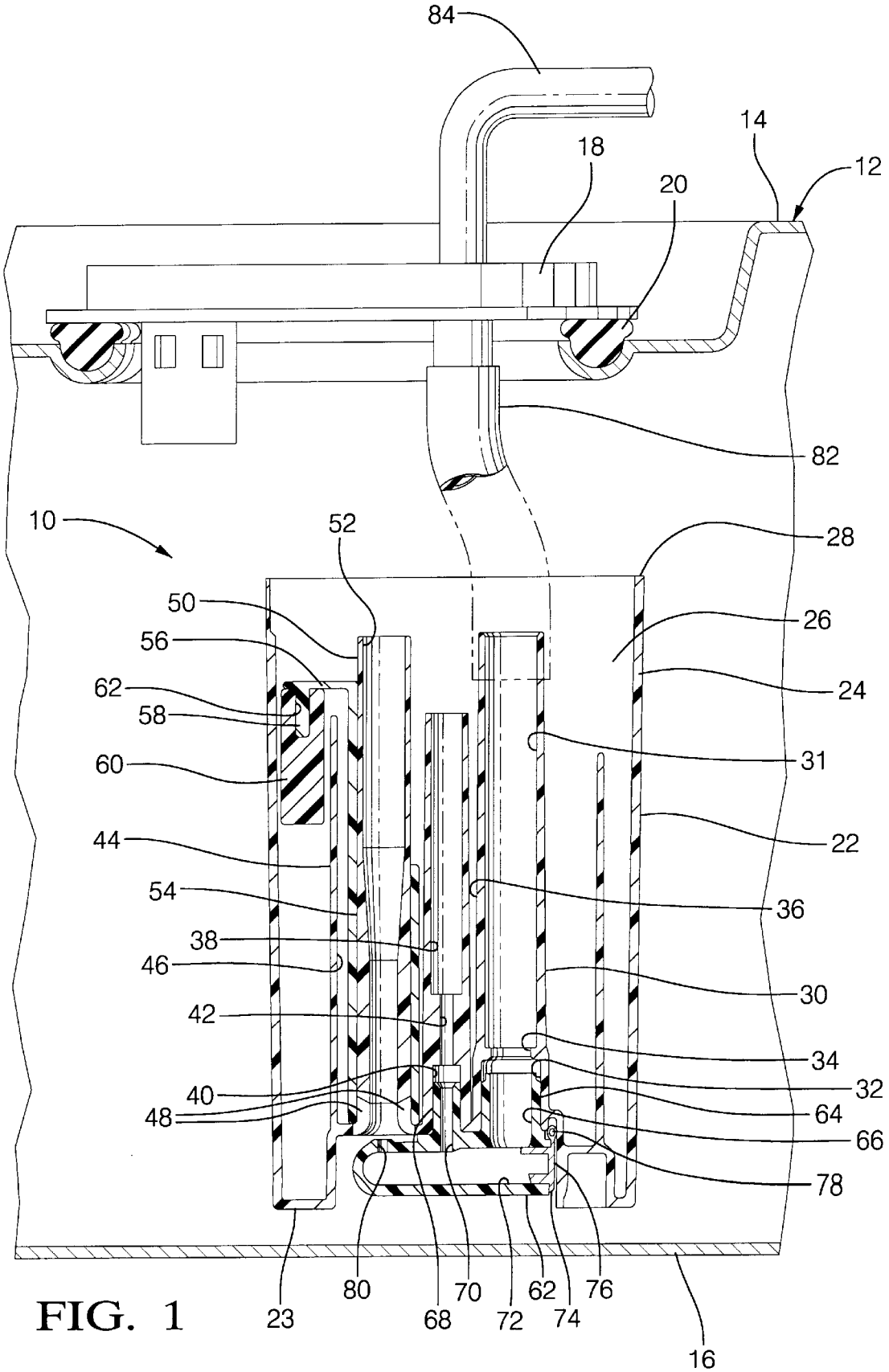
FIG. 1 is a fragmentary elevational view of a secondary fuel pump assembly, according to the present invention, illustrated in operational relationship with a fuel tank of a vehicle.
Figure 2:
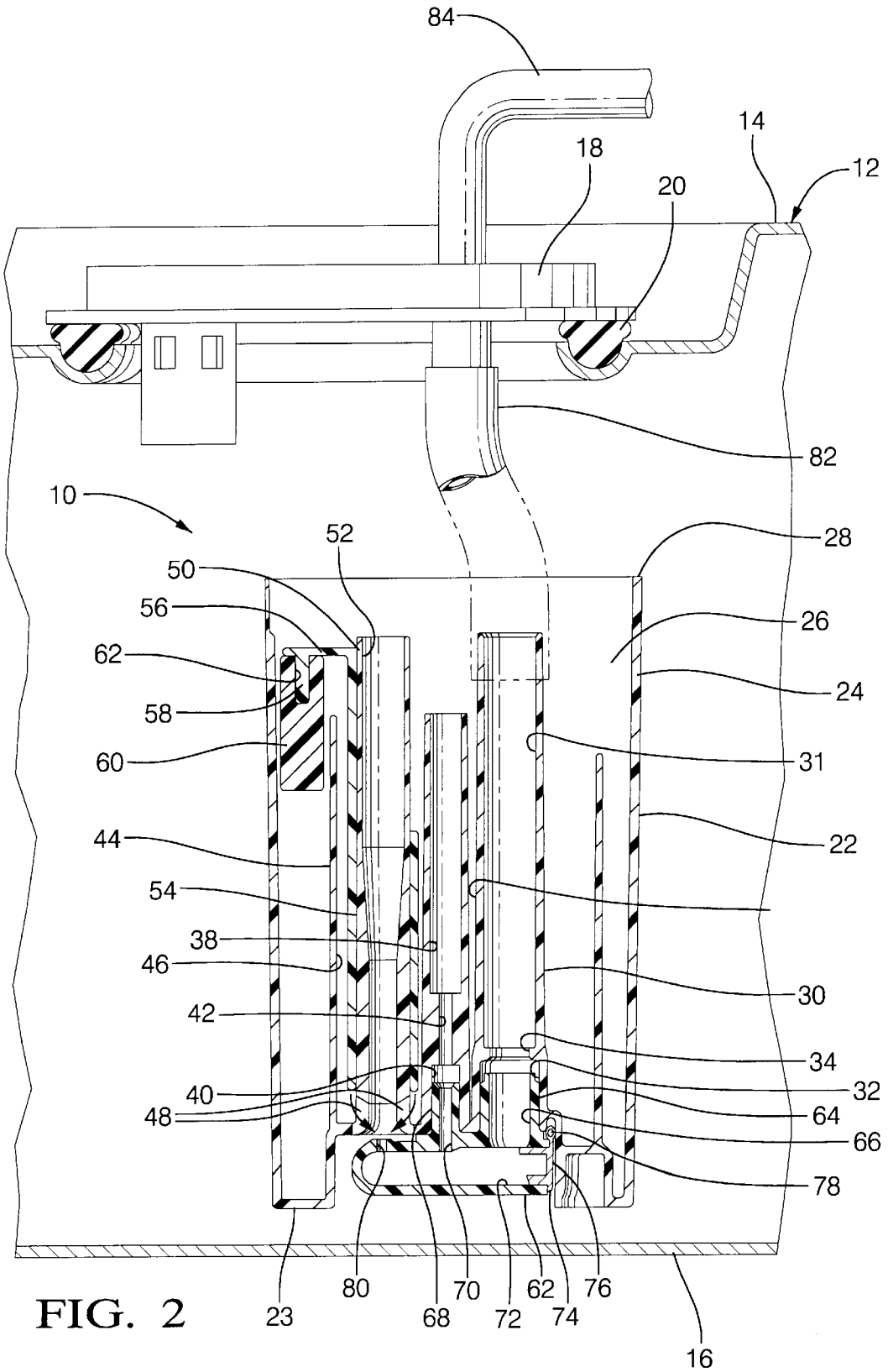
FIG. 2 is view similar to FIG. 1 illustrating the secondary fuel pump assembly in a second operational state.

Referring to the drawings and in particular FIGS. 1 and 2, one embodiment of a secondary fuel pump assembly 10, according to the present invention, is shown for a fuel tank, generally indicated at 12, in a vehicle (not shown). The fuel tank 12 has an upper wall 14 and a lower wall 16. The secondary fuel pump assembly 10 is disposed in the fuel tank 12 and has a removable cover 18 sealed by a seal ring 20 to the upper wall 14 of the fuel tank 12. It should be appreciated that, except for the secondary fuel pump assembly 10, the fuel tank 12 is conventional and known in the art.

The secondary fuel pump assembly 10 includes a fuel reservoir 22 to hold fuel disposed inside the fuel tank 12. The fuel reservoir 22 has a bottom portion 23 and an annular side portion 24 extending generally perpendicularly from the bottom portion 23 to form a chamber 26. The fuel reservoir 22 is generally bucket-shaped and open at a top end 28 thereof, which defines an overflow fuel level in the fuel reservoir 22. It should be appreciated that the top end 28 is above the highest level of new fuel in the fuel tank 12 so that there is little or no in-and-out flow over the top. It should also be appreciated that the top end may be partially closed to minimize splash-over while still venting the interior of the fuel reservoir 22.

The secondary fuel pump assembly 10 also includes a return fuel member 30 extending upwardly from the bottom portion 23 of the fuel reservoir 22. The return fuel member 30 is tubular and has a generally circular cross-sectional shape. The return fuel member 30 has a passageway 31 extending axially therethrough. The return fuel member 30 has a cavity 32 in a bottom thereof and aperture 34 interconnecting the passageway 31 and the cavity 32. The return fuel member 30 is integral and formed as one-piece with the fuel reservoir 22. It should be appreciated that the return fuel member 30 extends into the chamber 26 of the fuel reservoir 22.

The secondary fuel pump assembly 10 includes a jet pump member 36 extending upwardly from the bottom portion 23 of the fuel reservoir 22. The jet pump member 36 is tubular and has a generally circular cross-sectional shape. The jet pump member 36 has a passageway 38 extending axially therethrough. The jet pump member 36 has a cavity 40 in a bottom thereof and aperture 42 interconnecting the passageway 38 and the cavity 40. The jet pump member 36 is integral and formed as one-piece with the fuel reservoir 22. It should be appreciated that the jet pump member 36 extends into the chamber 26 of the fuel reservoir 22.

The secondary fuel pump assembly 10 also includes an overflow fuel member 44 extending upwardly from the bottom portion 23 of the fuel reservoir 22. The overflow fuel member 44 has a cavity 46 and a pair of apertures 48 in the bottom thereof interconnecting the cavity 46 and the interior of the fuel tank 12. The overflow fuel member 44 is integral and formed as one-piece with the fuel reservoir 22. It should be appreciated that the overflow fuel member 44 extends into the chamber 26 of the fuel reservoir 22.

The secondary fuel pump assembly 10 includes a guide member 50 extending upwardly from the bottom portion 23 of the fuel reservoir 22 and through the overflow fuel member 44. The guide member 50 is tubular and has a generally circular cross-sectional shape. The guide member 50 has a passageway 52 extending axially therethrough. The guide member 50 is integral and formed as one-piece with the fuel reservoir 22. It should be appreciated that the guide member 50 extends into the chamber 26 of the fuel reservoir 22.

The secondary fuel pump assembly 10 also includes a guide 54 disposed about the guide member 50 and movable axially relative thereto. The guide 54 is tubular and has a generally circular cross-sectional shape. The guide 54 has a flange 56 extending radially from an upper end thereof and overlapping the upper end of the overflow fuel member 44. The guide 54 also has a projection 58 extending downwardly perpendicularly from the flange 56 for a function to be described. The guide 54 is integral and formed as one-piece. It should be appreciated that the guide 54 is movable or slideable along the guide member 50.

The secondary fuel pump assembly 10 further includes a float 60 connected to the guide 54. The float 60 extends axially. The float 60 is generally cylindrical in shape with a generally circular cross-sectional shape. The float 60 has a cavity 62 extending axially inward to receive the projection 58 of the guide 54 and be secured thereto by conventional means such as heat stake or an interference fit. The float 60 is made of a material being less dense than the fuel such as such as polyurethane, or blow molded from acetyl or nylon. It should be appreciated that the float 60 may have any suitable shape.

The secondary fuel pump assembly 10 also includes a secondary or jet pump 62 cooperating with the jet pump member 36. The jet pump 62 has a first projection 64 extending outwardly and disposed in the cavity 32 of the fuel return member 30. The first projection 64 is generally tubular in shape with a generally circular cross-sectional shape. The first projection 64 has an aperture 66 extending therethrough. The jet pump 62 has a second projection 68 extending outwardly and spaced laterally from the first projection 64 and disposed in the cavity 40 of the jet pump member 36. The second projection 68 is generally tubular in shape with a generally circular cross-sectional shape. The second projection 68 has an aperture 70 extending therethrough. The jet pump 62 has a cavity 72 communicating with the apertures 66 and 70 and having an open end 74. The jet pump 62 has a plug 76 closing the open end 74 with a projection 78 securing the plug 76 to the first projection 64. The jet pump 62 has an aperture 80 extending therethrough and communicating with the cavity 72.

The secondary fuel pump assembly 10 also includes a conduit or hose 82 connected to one end of the fuel return member 30 and a fuel connector 84 extending through the cover 18. It should be appreciated that the fuel connector 84 returns hot fuel to the secondary fuel pump assembly 10.

In operation, the secondary fuel pump assembly 10 is illustrated in an assembled state in FIG. 1 in which the guide 54 and float 60 are near a bottom of the fuel reservoir 22 during a reservoir full of fuel condition. Hot fuel from the engine returns via the fuel connector 84 and hose 82 to the return fuel member 30. Hot fuel flows through the passageway 31 and aperture 34 of the fuel return member 30 to the jet pump 62. In the jet pump 62, hot fuel flows through the aperture 66 in the first projection 64 to the cavity 72 and through the aperture 70 in the second projection 68 to the jet pump member 36. Hot fuel flows through the passageway 38 of the jet pump member 36 and into the chamber 26 of the reservoir 22 to fill the reservoir 22. As the fuel level rises in the fuel reservoir 22, the float 60 also rises to elevate or move the guide 54 upward and opening the apertures 48 in the overflow fuel member 44 as illustrated in FIG. 2. As a result, fuel is aspirated from the fuel reservoir 22 through the apertures 48 and into the interior of the fuel tank 12. As the fuel level falls in the reservoir 22, the float 60 also falls and lowers the guide 54 downward toward the bottom of the fuel reservoir 22 to close the apertures 48 in a reservoir empty condition. Fuel is recirculated within the fuel reservoir 22 when sufficient fuel is in the reservoir 22 to allow fuel to spill into the overflow fuel member 44. Bulk fuel is drawn into the reservoir 22 only when fuel is not being returned through the overflow fuel member 44. It should be appreciated that the "contained" feature allows the preferential use of "hot" fuel and vapor generation is minimized. It should be appreciated that fuel being returned from the engine or fuel being by-passed by a fuel regulator (not shown) has a variable flow to the low-pressure jet pump 62 as a result of the fuel being used by the engine. It should also be appreciated that the vacuum being generated by the jet pump 62 is continuously varying.

Figure 3:
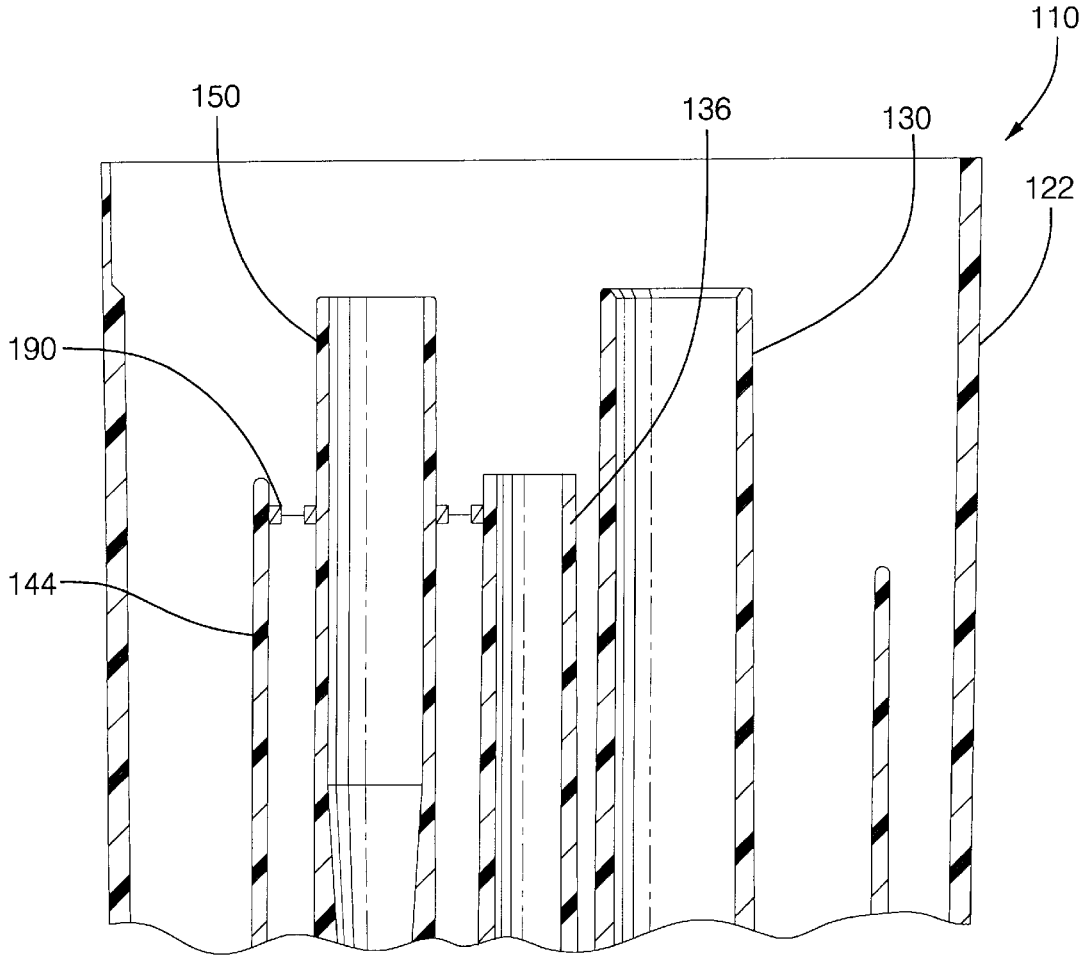
FIG. 3 is a partial fragmentary view of another embodiment, according to the present invention, of the secondary fuel pump assembly of FIG. 1.

Referring to FIG. 3, another embodiment 110, according to the present invention, of the secondary fuel pump assembly 10 is shown. Like parts of the secondary fuel pump assembly 10 have like reference numerals increased by one hundred (100). In this embodiment, the secondary fuel pump assembly 110 includes a disc strainer 190 disposed in the overflow fuel member 144 and about the guide member 150 at one longitudinal end. The disc strainer 190 is generally circular in shape. The disc strainer 190 allows fuel to pass and provides a capillary seal. The disc strainer 190 is made of a filtering material such as woven fabric. It should be appreciated that the operation of the secondary fuel pump assembly 110 is similar to the secondary fuel pump assembly 10, except that the jet pump 162 preferentially draws from the fuel reservoir 122.

Figure 4:
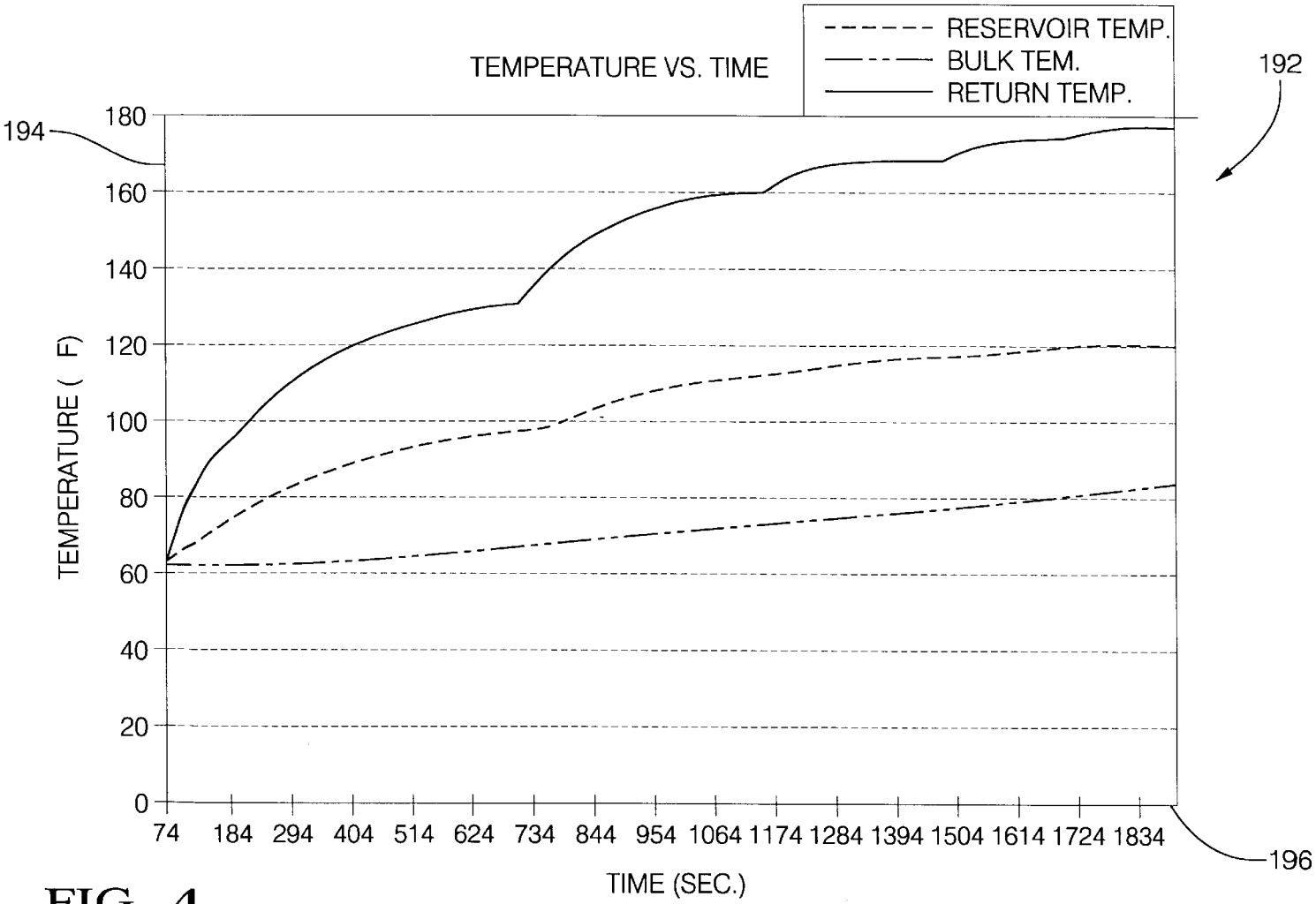
FIG. 4 is a graph of temperature versus time for the secondary fuel pump assembly of FIG. 1.

Referring to FIG. 4, a graph 192 of temperature on a y-axis 194 and time on an x-axis 196 is shown for the secondary fuel pump assembly 10. The graph 192 illustrates good separation in the temperatures of the bulk fuel and the reservoir fuel.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A secondary fuel pump assembly for a fuel tank in a vehicle comprising:

a reservoir adapted to be disposed in the fuel tank having a top defining an overflow fuel level of said reservoir;

a conduit conducting return fuel from an engine of the vehicle to said reservoir;

a jet pump having a discharge outlet in said reservoir and an inlet operatively connected to said conduit;

an overflow fuel member defining a flow path for overflow of fuel in said reservoir;

a guide member extending into said overflow fuel member and having at least one aperture extending therethough;

a guide disposed over said guide member and movable relative thereto to open and close said at least one aperture; and a float connected to said guide to move said guide as a fuel level rises and falls in said reservoir.

2. A secondary fuel pump assembly as set forth in claim 1 wherein said reservoir forms a chamber and includes a return fuel member extending into said chamber and connected to said conduit.

3. A secondary fuel pump assembly as set forth in claim 2 wherein said return fuel member has a passageway extending therethrough, a cavity to receive said inlet of said jet pump and an aperture extending between said passageway and said cavity.

4. A secondary fuel pump assembly as set forth in claim 2 wherein said reservoir includes a jet pump member extending into said chamber and cooperating with said jet pump.

5. A secondary fuel pump assembly as set forth in claim 4 wherein said jet pump member has a passageway extending therethrough, a cavity to receive said outlet of said jet pump and an aperture extending between said passageway and said cavity.

6. A secondary fuel pump assembly as set forth in claim 1 wherein said float is made of a material having a density less than a density of the fuel.

7. A secondary fuel pump assembly as set forth in claim 1 wherein said float is generally cylindrical in shape.

8. A secondary fuel pump assembly as set forth in claim 2 wherein said guide member extends from said reservoir and into said chamber and having a passageway extending therethrough, said at least one aperture extending through a bottom portion thereof.

9. A secondary fuel pump assembly as set forth in claim 8 wherein said guide has a flange extending over an upper end of said overflow fuel member, said float being connected to said flange.

10. A secondary fuel pump assembly as set forth in claim 1 wherein said reservoir and said overflow fuel member and said guide member are integral and one-piece.

11. A secondary fuel pump assembly as set forth in claim 1 including a disc strainer disposed in said overflow fuel member to strain fuel flowing therein.

12. A secondary fuel pump assembly for a fuel tank in a vehicle comprising:

a reservoir adapted to be disposed in the fuel tank having a top defining an overflow fuel level of said reservoir;

a conduit conducting return fuel from an engine of the vehicle to said reservoir;

wherein said reservoir forms a chamber and includes a return fuel member extending into said chamber and connected to said conduit;

wherein said reservoir includes a jet pump member extending into said chamber;

a jet pump having a discharge outlet connected to said jet pump member and an inlet connected to said return fuel member;

an overflow fuel member defining a flow path for overflow of fuel in said reservoir;

a guide member extending into said overflow fuel member and having at least one aperture extending therethough;

a guide disposed over said guide member and movable relative thereto to open and close said at least one aperture; and a float connected to said guide to move said guide as a fuel level rises and falls in said reservoir.

13. A secondary fuel pump assembly as set forth in claim 12 wherein said return fuel member has a passageway extending therethrough, a cavity to receive said inlet of said jet pump and an aperture extending between said passageway and said cavity.

14. A secondary fuel pump assembly as set forth in claim 12 wherein said jet pump member has a passageway extending therethrough, a cavity to receive said outlet of said jet pump and an aperture extending between said passageway and said cavity.

15. A secondary fuel pump assembly as set forth in claim 12 wherein said guide member extends from said reservoir and into said chamber and having a passageway extending therethrough, said at least one aperture extending through a bottom portion thereof.

16. A secondary fuel pump assembly as set forth in claim 15 wherein said guide has a flange extending over an upper end of said overflow fuel member, said float being connected to said flange.

17. A secondary fuel pump assembly as set forth in claim 12 wherein said reservoir and said overflow fuel member and said guide member are integral and one-piece.

18. A secondary fuel pump assembly as set forth in claim 12 including a disc strainer disposed in said overflow fuel member to strain fuel flowing therein.

19. A secondary fuel pump assembly as set forth in claim 12 wherein said float is made of a material having a density less than a density of the fuel.

20. A fuel tank assembly for a vehicle comprising:

a fuel tank;

a fuel reservoir disposed in said fuel tank having a top defining an overflow fuel level of said reservoir;

a conduit conducting return fuel from an engine of the vehicle to said reservoir;

a jet pump having a discharge in said reservoir and an inlet connected to said conduit;

an overflow fuel member defining a flow path for overflow of fuel in said reservoir;

a guide member extending into said overflow fuel member and having at least one aperture extending therethough;

a guide disposed over said guide member and movable relative thereto to open and close said at least one aperture; and a float connected to said guide to move said guide as a fuel level rises and falls in said reservoir.

* * * * *